US006505978B2

(12) United States Patent
Earle et al.

(10) Patent No.: US 6,505,978 B2
(45) Date of Patent: Jan. 14, 2003

(54) PROCESSING PHOTOGRAPHIC MATERIAL

(75) Inventors: Anthony Earle, Harrow Weald (GB); Nigel R. Wildman, Watford Hertfordshire (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/014,962

(22) Filed: Dec. 11, 2001

(65) Prior Publication Data

US 2002/0114629 A1 Aug. 22, 2002

(30) Foreign Application Priority Data

Dec. 21, 2000 (GB) ..... 0031197

(51) Int. Cl.[7] ..... G03D 3/04; G03D 3/08; G03D 17/00

(52) U.S. Cl. ..... 396/599; 396/617; 396/620; 396/633

(58) Field of Search ..... 396/599, 617, 396/620, 626, 633, 636; 355/27–29

(56) References Cited

U.S. PATENT DOCUMENTS

| | | | | | |
|---|---|---|---|---|---|
| 3,110,595 | A | * | 11/1963 | Roman | 396/633 |
| 4,168,899 | A | * | 9/1979 | Klass | 396/633 |
| 5,023,644 | A | | 6/1991 | Kurematsu et al. | 396/626 |
| 5,238,805 | A | * | 8/1993 | Saituo | 430/569 |
| 5,452,043 | A | | 9/1995 | Patton et al. | 396/626 |
| 5,678,120 | A | * | 10/1997 | Redden | 396/633 |
| 6,076,980 | A | * | 6/2000 | Piccinino, Jr. et al. | 396/617 |

FOREIGN PATENT DOCUMENTS

| | | |
|---|---|---|
| EP | 0 061 300 | 9/1982 |
| EP | 1 111 457 A1 | 6/2001 |
| GB | 342387 | 2/1931 |
| GB | 382537 | 10/1932 |

* cited by examiner

*Primary Examiner*—D Rutledge
(74) *Attorney, Agent, or Firm*—Frank Pincelli

(57) ABSTRACT

A method of processing photographic material in which a reciprocable member is plunged into a tank containing a small volume of processing solution. The solution is rapidly displaced through the channels created between the tank wall and the plunger and across the surface of the photographic material.

12 Claims, 3 Drawing Sheets

PROCESSING PHOTOGRAPHIC MATERIAL

FIELD OF THE INVENTION

This invention relates to a method and apparatus for processing photographic material. In particular the invention relates to a single use processor.

BACKGROUND OF THE INVENTION

Conventional processing of photographic material requires the use of large tanks of processing solutions. Typically these processing tanks have volumes greater than three liters. Each tank contains a processing solution such as developer, bleach, fixing solution or washing solution. The material is transported through each tank in turn. There is a tendency for the solutions to carry over from one tank to another leading to pollution of the solutions. Conventional processing has several other drawbacks. The temperatures which can be utilized are limited and therefore the process is slow. The composition of the solutions must be stable over long time periods in the processing tanks. The processing apparatus is also very large due to the number of processing tanks. To overcome these problems low volume thin tanks were developed. Replenishment of these solutions is difficult to control. The low volume thin tanks reduced capacity to about one liter. An example of such a low volume thin tank is the Noritsu V30 film processor.

Low volume thin tanks currently operate in a state of dynamic equilibrium and process control is required.

It is desirable to reduce the volumes of low volume thin tanks further to that of the replenishment rate of the process (for a given length of film) or even lower. In order to do this volumes can be made small but the chemical content of such small volumes needs to increase greatly as we need to be able to develop Dmax in any area of the film and no exposure history is known. This requirement becomes prohibitive as the volume approaches that of the film gelatin swell. GB 9930140.0 discloses a method and apparatus for processing photographic material in which the low volume of applied solution can be reused by moving it about the film surface with a porous pad. This reduces the component requirement in any part of the film. The method disclosed in GB 9930140.0 relies on low volume and high physical agitation to replenish areas where the swollen gelatin is exhausted of developing agent or saturated in seasoning components. This method has become known as Dynamic Single Use (DSU). Problems with the pads arise due to pressure sensitivity lines and evaporation from the heated film. It is also not obvious how the pad would be operated in the field or cleaned and/or replaced.

SUMMARY OF THE INVENTION

The present invention solves these problems by maintaining the solution in a tank that can be heated, easily loaded and unloaded and is self cleaning if all of the process occurs in the same tank.

According to the present invention there is provided a method of processing photographic material comprising the steps of transporting the material to be processed into at least one tank containing a predetermined volume of processing solution and plunging a reciprocable member into the tank to thereby rapidly displace the solution through the narrow channels created between the tank and member and thus across the surface of the material.

The present invention further provides an apparatus for processing photographic material comprising at least one tank containing a predetermined volume of processing solution, an equivalent number of reciprocable members for plunging into each respective tank and means for transporting the material into and out of the at least one tank.

Preferably a plurality of reciprocable members are provided.

The invention overcomes the problems of the prior art. The processor is of low volume, provides high agitation and wets the whole film quickly. This avoids seasoning effects between opposite ends of the film.

Temperature control is easy at elevated temperatures and higher temperature solutions can be utilized than in conventional tanks. This enables more rapid processing. Unstable processing solutions can be used as only small volumes are required. These solutions can then be disposed of after use. If the process ends with a wash step the processor is self cleaning.

BRIEF DESCRIPTION OF THE DRAWINGS

The invention will now be described with reference to the accompanying drawings, in which.

DETAILED DESCRIPTION OF THE INVENTION

Figure 1:
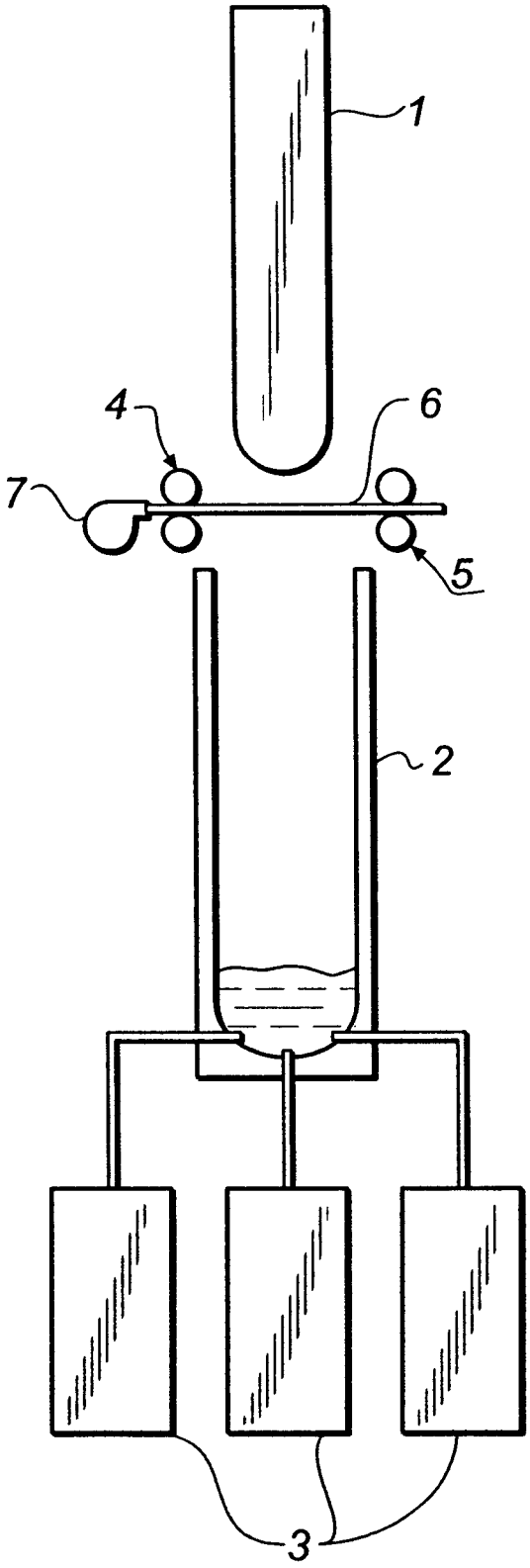
FIG. 1 is a schematic view of an embodiment of the invention.

FIG. 1 shows a schematic view of a first embodiment of the invention.

The apparatus consists of a low volume tank 2 into which a central agitating member or plunger 1 is reciprocated. The relative sizes of the tank 2 and the plunger 1 are such that only a very narrow channel is left when the plunger 1 is within the tank. The width of the channel is typically between 0.25 mm and 1 mm. A plurality of reservoirs 3 are in fluid connection with the tank 2. Each reservoir contains the processing fluids required by the process. The processing fluids may be reused or disposed of after use. A pair of pinch rollers 4, 5 are provided at the entry and exit of the tank 2. The material to be processed, in this example film 6, is transported into and out of the tank by the action of the rollers, 4 and 5. The film may be processed whilst still attached to the film cassette 7. This is shown more clearly in FIGS. 2A and 2B. The invention is applicable whether the film is housed in an APS cassette or in a 35 mm cassette.

The film 6 is fed into the tank 2 with the emulsion side facing outwards. Developer is fed into the tank 2. The film displaces its own volume in developer and hence allows rapid wetting of the total film in the narrow channel with a very small volume. It is known that in order not to observe a seasoning effect from the wetting solution along the film that the whole film needs to be wetted in the small volume in about three seconds. The method of the invention allows this to happen as the solution is rapidly displaced up the narrow channels containing the film. The film 6 is also agitated when the plunger 1 is reciprocated up and down over the development time. The agitation can be further embellished by placing materials known to provide a physical rubbing action on the tank wall. Such materials need to be chosen to achieve the agitation without imparting physical damage to the emulsion surface to be processed. These can be any known conventional materials such as fine nylon mesh coated with pvc, velvet plush as found in film cassettes or plushes typically found on porous pads used in photographic processing. These are examples only and it will be understood by those skilled in the art that the invention is not limited to such materials. Loading and unloading of the invention presents no engineering difficulties as envisaged.

Figure 2B:
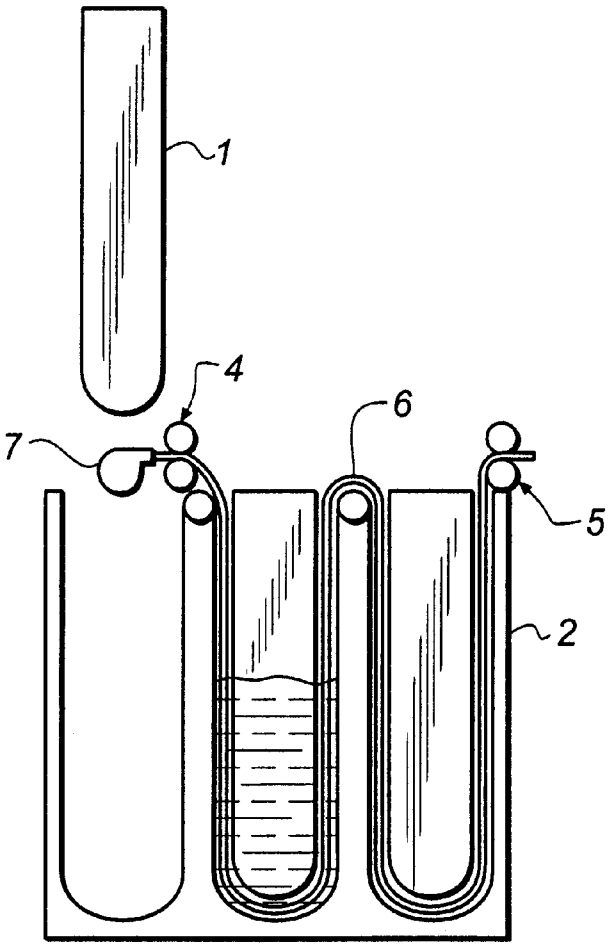
FIGS. 2A and 2B are a schematic views of a second embodiment of the invention.
Figure 2A:
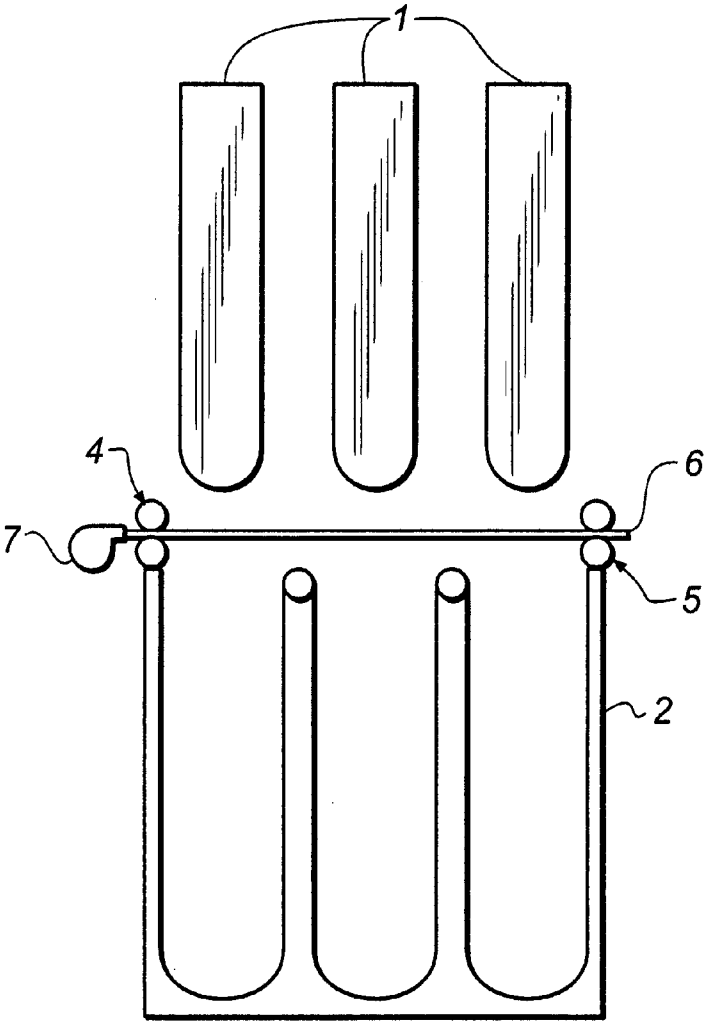

FIG. 2 shows a further embodiment of the invention. This embodiment provides a plurality of plungers, three in the example shown. Each plunger descends into a corresponding tank. This allows the processing apparatus to occupy less volume than the single loop for a given length of film. It is expected that a forty exposure APS film could be accommodated in a processor of 26 cm depth. The multiple plunger embodiment also allows different length films to be processed. For a film of fifteen exposures just the central plunger would be used. For a film with twenty five exposures the central tank and plunger and one other could accommodate the film length. All three tanks and plungers would accommodate a forty exposure roll of film. The length of film from the very end thereof to the first processed section is maintained the same throughout, regardless of how many tanks are to be used. FIG. 2B illustrates how if not all the plungers 1 are to be used the feeding apparatus, including the pinch rollers and the film cassette, is moved toward the tanks to be used. In this embodiment only two, the second and third, tanks are to be used. The feeding apparatus is therefore moved as shown over the first tank.

The apparatus would need to be heated to maintain the correct temperature for processing. This could be achieved by heating a fluid, such as water, that resides in cavities inside the processor, not shown. Rather than making this water redundant volume, it could be used as the wash water and/or any chemical required by the process. Thus the processor and chemistry is maintained at the correct temperature ready for the next film and is not in contact with the air which may cause oxidation of certain chemicals.

The replenisher could be delivered from the plunger that acts as the replenisher cartridge or from a cartridge that sits on top of the plunger or elsewhere in the machine.

EXAMPLE

Developer was made that comprised of the following;

| | |
|---|---|
| $Na_3PO_4$, $12H_2O$ | 50 g/L |
| Antioxidant | 10 g/L |
| KBr | 5 g/L |
| CD4 | 5 g/L |
| KOH 50% to | pH 11.5 |
| Surfactant: 10 drops/L 32% TX200 | |

Figure 3:
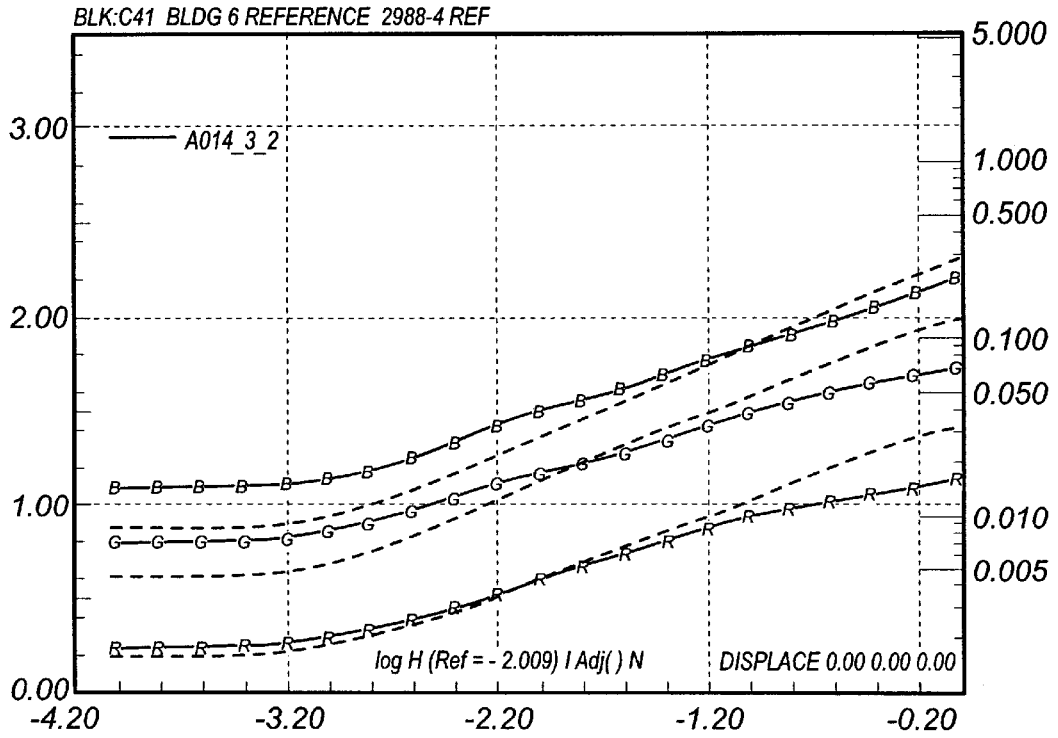
FIG. 3 is a graph illustrating the results of one example of the invention.
Figure 4:
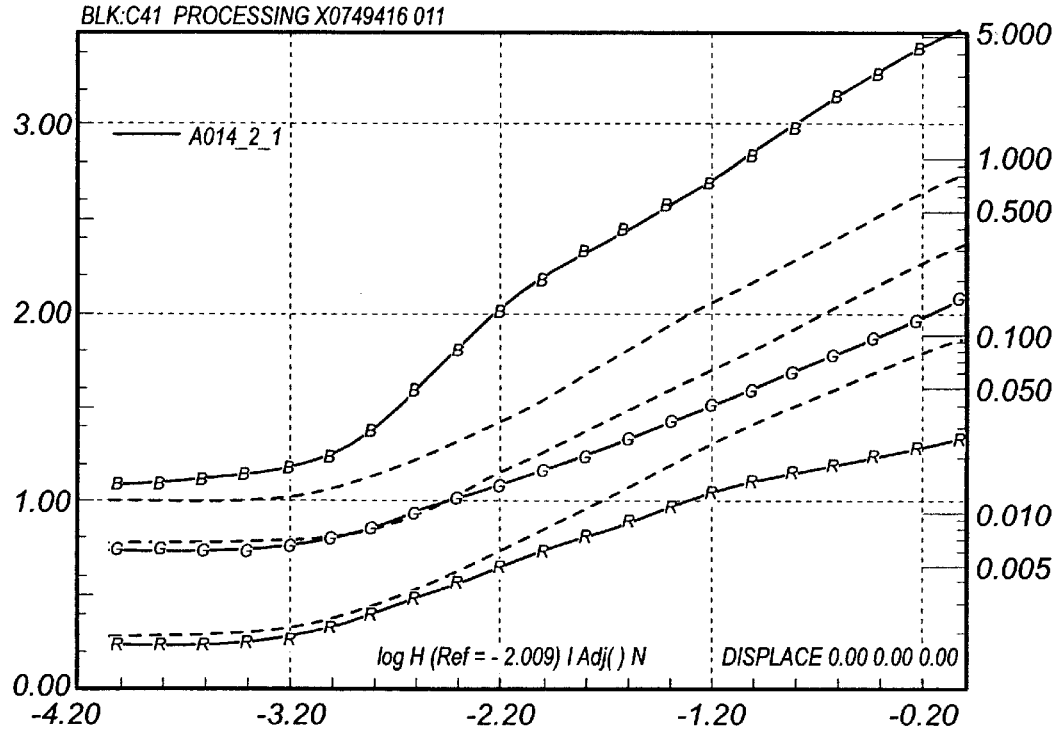
FIG. 4 is graph illustrating the results of a second example of the invention.

80 ml of developer (80 ml machine capacity) was added to the displacement processor that contained a film of 40 exposure length. The films used were a scan film, as disclosed in copending application, Kodak reference docket 81063, see FIG. 3, and Royal Gold 400, see FIG. 4. The developer was agitated once per second by raising and lowering the plunger at a temperature of 50° C. for 40 seconds. At 40 seconds the Stop bath was added (5 ml/L Glacial acetic acid +5 g/L sodium sulphite). The process was stopped for one minute before the solution was removed from the processor. At this point 80 ml of bleach was added and agitated as before. After three minutes this was removed and 80 ml of fixer added for a further three minutes. The film was then washed and dried externally from the device. The sensitometric curves shown in FIGS. 3 and 4 were obtained. These can be corrected by scan printing onto output media. The method of the invention is not designed to yield optically printable negatives. An identical result can be achieved by keeping the plunger in the lower position and circulating the solution in the processor by means of a small positive displacement pump. The process wash water may be used as heating water. Alternatively chemicals can be used as heating solutions for the processor.

The processor of the invention can accommodate any cycle. The cycle can be quickly changed as required. Different lengths of film may be accommodated by changing the number of plungers and tanks used as described above. Having a plurality of plungers reduces the size of the apparatus to a more compact design. The tank may be sealed after processing has occurred and can be left to keep warm with the last wash of the previous process inside.

The present invention has been described in detail with reference to preferred embodiments. It will be understood by those skilled in the art that variations and modifications may be effected within the scope of the invention.

What is claimed is:

1. A method of processing photographic material comprising the steps of transporting the material to be processed into at least one tank containing a predetermined volume of processing solution and plunging a reciprocable member into the tank to thereby rapidly displace the solution through the narrow channels created between the tank and member and thus across the surface of the material.

2. A method as claimed in claim 1 wherein the solution is agitated further by reciprocating the member into and out of the at least one tank through the duration of the process.

3. A method as claimed in claim 1 wherein the solution is agitated further by circulating the solution by means of a pump.

4. A method as claimed in claim 1 wherein the solution is agitated further by providing agitation means on the wall of the tank.

5. A method as claimed in claim 1 wherein the number of tanks and reciprocable members used is dependent on the length of the material to be processed.

6. A method as claimed in claim 1 wherein the photographic material is processed whilst still attached to a cassette.

7. A method as claimed in claim 1 wherein the solution is heated whilst in the at least one tank.

8. A method as claimed in claim 1 wherein processing solutions are sequentially added and removed from the at least one tank.

9. An apparatus for processing photographic material comprising at least one tank containing a predetermined volume of processing solution, an equivalent number of reciprocable members for plunging into each respective tank and means for transporting the material into and out of the at least one tank.

10. An apparatus as claimed in claim 9 wherein a pump is provided for further agitation of the solution.

11. An apparatus as claimed in claim 9 wherein agitation members are provided on the wall of the tank.

12. An apparatus as claimed in claim 9 further including heating means for heating the solution.

* * * * *